US006544131B1

(12) United States Patent
Sano et al.

(10) Patent No.: US 6,544,131 B1
(45) Date of Patent: Apr. 8, 2003

(54) MULTI-PIECE SOLID GOLF BALL HAVING GOOD SHOT FEEL

(75) Inventors: Yoshinori Sano, Fukuchiyama (JP); Hiroaki Tanaka, Kobe (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

(21) Appl. No.: 09/248,117

(22) Filed: Feb. 11, 1999

(30) Foreign Application Priority Data

Feb. 16, 1998 (JP) ..... 10-032704

(51) Int. Cl.[7] ..... A63B 37/04; A63B 37/06

(52) U.S. Cl. ..... 473/374; 473/361; 473/364; 473/370; 473/373; 473/376

(58) Field of Search ..... 473/361, 364, 473/370, 373, 374, 376

(56) References Cited

U.S. PATENT DOCUMENTS 5,184,828 A 2/1993 Kim et al. ..... 273/228
5,601,503 A * 2/1997 Yamagishi ..... 473/384
5,772,531 A * 6/1998 Ohsumi ..... 473/376
5,779,562 A * 7/1998 Melvin ..... 473/373
5,792,009 A * 8/1998 Maruko ..... 473/359
5,820,492 A * 10/1998 Yamagishi ..... 473/377

FOREIGN PATENT DOCUMENTS

JP 60-241464 * 11/1985
JP 2614791 2/1997

* cited by examiner

*Primary Examiner*—Peter Vo
*Assistant Examiner*—Paul Kim
(74) *Attorney, Agent, or Firm*—Birch, Stewart, Kolasch & Birch, LLP

(57) ABSTRACT

The present invention relates to a multi-piece solid golf ball comprising a core consisting of an inner core and an outer core formed on the inner core, and one or more layers of cover covering the core, wherein the inner core has a diameter of 34.0 to 37.4 mm and a JIS-C center hardness of 65 to 75, the outer core has a thickness of 0.8 to 2.0 mm and a JIS-C surface hardness of 75 to 85, and the cover has a shore D hardness of 45 to 70, and contains ionomer resin as a base resin.

5 Claims, 2 Drawing Sheets

MULTI-PIECE SOLID GOLF BALL HAVING GOOD SHOT FEEL

FIELD OF THE INVENTION

The present invention relates to a multi-piece solid golf ball. More particularly, it relates to a multi-piece solid golf ball having excellent durability, excellent rebound characteristics and good shot feel at the time of hitting.

BACKGROUND OF THE INVENTION

In the history of golf balls, a thread wound golf ball has been firstly developed. The thread wound golf ball is obtained by winding thread rubber in a stretched state on a solid or liquid center to form a thread wound core and covering it with a cover of balata, etc. having a thickness of 1 to 2 mm.

A two-piece solid golf ball has been subsequently developed, which is composed of a core formed from integrally molded rubber material and a thermoplastic resin cover (e.g. ionomer resin cover) formed on the core. The two-piece solid golf ball is easily produced because of simple structure, and has excellent rebound characteristics and excellent durability. Therefore, the two-piece solid golf ball is generally approved or employed by many golfers, mainly amateur golfers.

However, the two-piece solid golf ball exhibits harder and poorer shot feel at the time of hitting than the thread wound golf ball. It is difficult to put spin on the two-piece solid golf balls, resulting in poor controllability with approach shots. The difficulty of putting spin on the ball comes from the structural features of the solid golf ball that a ball velocity is high, when hitting, and a contact area of the ball with a hitting face of a golf club is small.

In order to provide a two-piece solid golf ball having shot feel as good as the thread wound golf ball, a soft type two-piece solid golf ball using a softer core has been proposed. However, the use of the soft core adversely affects on rebound characteristics, thus resulting in the reduction of flight distance and the deterioration of durability.

Then, it has been proposed that an intermediate layer is placed between the core and the cover of the two-piece solid golf ball to form a three-piece solid golf ball so as to keep the balance between flight performance and shot feel at the time of hitting. For example, a three-piece solid golf ball of which a two-piece core composed of a core and an intermediate layer has a specified range of thickness, hardness, specific gravity and the like is suggested. The intermediate layer is formed from vulcanized rubber material having the same composition as the core. For example, Japanese Patent No. 2614791 suggests a three-piece solid golf ball in which an inner core has a diameter of 23 to 35 mm and a Shore D hardness of 30 to 62, an outer core has a diameter of 36 to 41 mm and a Shore D hardness of 30 to 56.

A conventional method of making a solid golf ball containing a two-layered core, including the above technique, generally comprises the steps of vulcanizing a rubber composition for an inner core by press-molding or injection molding to form a vulcanized spherical inner core, covering the inner core with a rubber composition for an outer core, and vulcanizing it again to form a multi-layered core. The producing method of the two-layered core, as explained above, is more complicated than the production of a one-layer core. In addition, the inner core is vulcanized twice including the vulcanization of the outer core and therefore is thermally deteriorated by the twice vulcanization to degrade rebound characteristics and durability.

OBJECTS OF THE INVENTION

A main object of the present invention is to provide a multi-piece solid golf ball having excellent durability and excellent rebound characteristics, while keeping good shot feel at the time of hitting.

According to the present invention, the object described above has been accomplished by adjusting a diameter and a center hardness of the inner core, a thickness and a surface hardness of the outer core, and a hardness of the cover to a specified range. The invention uses a method of making the two-layered core comprising the steps of covering an unvulcanized inner core with two vulcanized semi-spherical half-shells for the outer core to integrally mold and vulcanize it, thereby simplifying the manufacturing process. The present invention can provide a multi-piece solid golf ball having excellent durability and excellent rebound characteristics, while keeping good shot feel at the time of hitting.

This object as well as other objects and advantages of the present invention will become apparent to those skilled in the art from the following description with reference to the accompanying drawings.

SUMMARY OF THE INVENTION

The present invention provides a multi-piece solid golf ball comprising a core consisting of an inner core and an outer core formed on the inner core, and one or more layers of cover covering the core, wherein the inner core has a diameter of 34.0 to 37.4 mm and a JIS-C center hardness of 65 to 75, and is formed from press molded rubber composition comprising polybutadiene, a co-crosslinking agent, an organic peroxide and a filler, the outer core has a thickness of 0.8 to 2.0 mm and a JIS-C surface hardness of 75 to 85, and is formed from press molded rubber composition comprising polybutadiene, a co-crosslinking agent, an organic peroxide and a filler, and the cover has a Shore D hardness of 45 to 70, and contains ionomer resin as a base resin.

The present invention provides a method of making a multi-piece solid golf ball comprising the steps of:

(a) molding a rubber composition for an inner core to form an unvulcanized inner core, (b) vulcanizing and press-molding a rubber composition for an outer core to form a vulcanized semi-spherical half-shell for the outer core, (c) mounting the unvulcanized inner core formed in the step (a) on a concave of the vulcanized semi-spherical half-shell for the outer core formed in the step (b), covering the unvulcanized inner core with another vulcanized semi-spherical half-shell for the outer core formed in the same manner as the step (b), and vulcanizing and integrally press-molding it to form a two-layered core, and (d) covering the two-layered core with a cover.

DETAILED DESCRIPTION OF THE INVENTION

Figure 1:
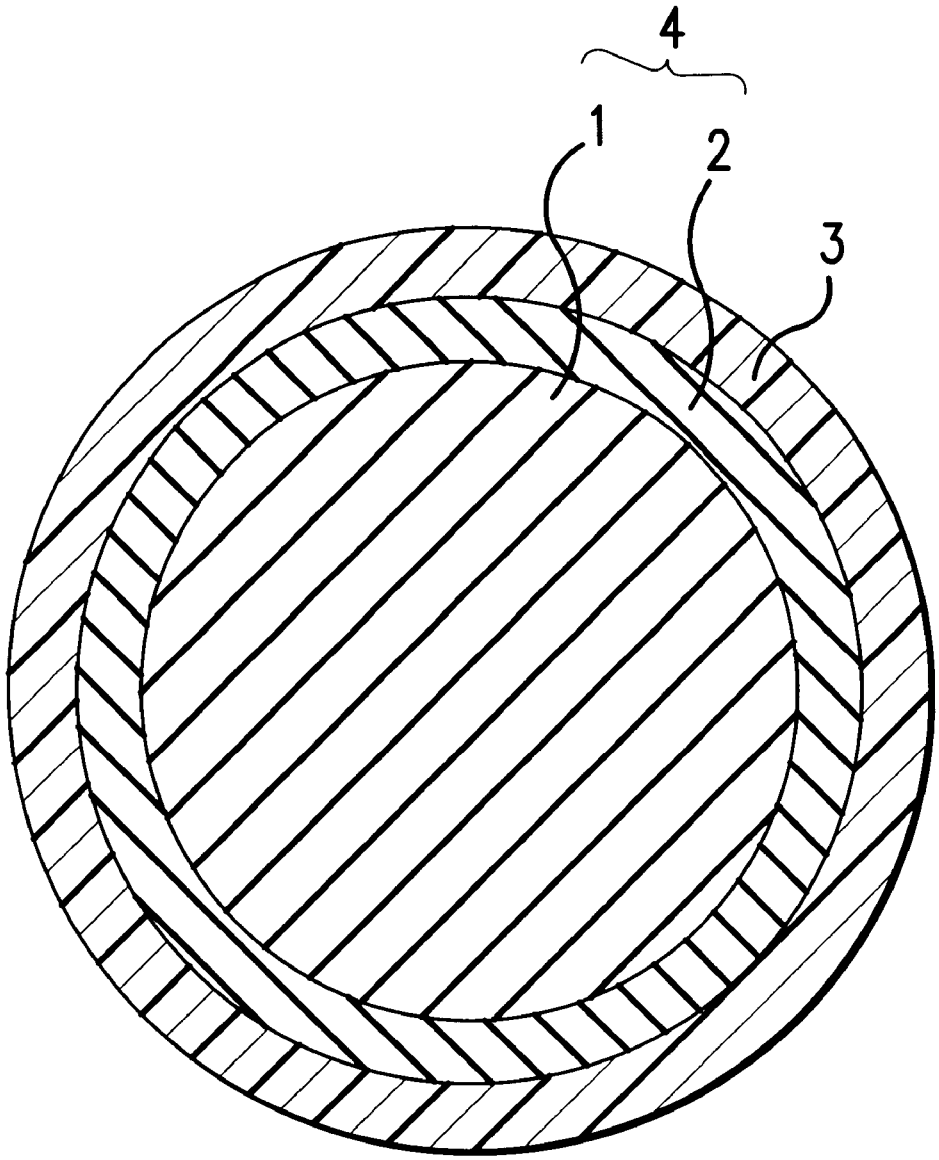
FIG. 1 is a schematic cross section illustrating one embodiment of the golf ball of the present invention.

The multi-piece solid golf ball of the present invention will be explained with reference to the accompanying drawing in detail. FIG. 1 is a schematic cross section illustrating one embodiment of the multi-piece solid golf ball of the present invention. As shown in FIG. 1, the golf ball of the present invention comprises a core 4 consisting of an inner core 1 and an outer core 2 formed on the inner core 1, and one or more layers of cover 3 covering the core 4. In order to simply explain the golf ball of the present invention, a golf ball having one layer of cover 3 will be used hereinafter for explanation. However, the golf ball of the present invention may be applied for the golf ball having two or more layers of cover.

The core 4, including both the inner core 1 and the outer core 2, is obtained from a rubber composition. The rubber composition essentially contains polybutadiene, a co-crosslinking agent, an organic peroxide and a filler.

The polybutadiene used for the core 4 of the present invention may be one which has been conventionally used for cores of solid golf balls. Preferred is high-cis polybutadiene rubber containing a cis-1, 4 bond of not less than 40%, preferably not less than 80%. The high-cis polybutadiene rubber may be optionally mixed with natural rubber, polyisoprene rubber, styrene-butadiene rubber, ethylene-propylene-diene rubber (EPDM) and the like.

The co-crosslinking agent can be a metal salt of α,β-unsaturated carboxylic acid, including mono or divalent metal salts, such as zinc or magnesium salts of α,β-unsaturated carboxylic acids having 3 to 8 carbon atoms (e.g. acrylic acid, methacrylic acid, etc.). Preferred co-crosslinking agent is zinc acrylate because it imparts high rebound characteristics to the resulting golf ball. An amount of the metal salt of the unsaturated carboxylic acid in the rubber composition is preferably from 5 to 70 parts by weight, preferably from 5 to 50 parts by weight, more preferably from 10 to 40 parts by weight, based on 100 parts by weight of the polybutadiene. When the amount of the metal salt of the unsaturated carboxylic acid is larger than 50 parts by weight, the core is too hard, and thus shot feel is poor. On the other hand, when the amount of the metal salt of the unsaturated carboxylic acid is smaller than 5 parts by weight, it is required to increase an amount of the organic peroxide in order to impart a desired hardness to the core. Therefore, rebound characteristics are degraded to reduce flight distance.

The organic peroxide includes, for example, dicumyl peroxide, 1,1-bis(t-butylperoxy)-3,3,5-trimethylcyclohexane, 2,5-dimethyl-2,5-di(t-butylperoxy) hexane, di-t-butyl peroxide and the like. Preferred organic peroxide is dicumyl peroxide. An amount of the organic peroxide is from 0.2 to 7.0 parts by weight, preferably 0.5 to 5.0 parts by weight, based on 100 parts by weight of the polybutadiene. When the amount of the organic peroxide is smaller than 0.2 parts by weight, the core is too soft. Therefore, rebound characteristics are degraded to reduce flight distance. On the other hand, when the amount of the organic peroxide is larger than 7.0 parts by weight, it is required to decrease an amount of the metal salt of α,β-unsaturated carboxylic acid in order to impart a desired hardness to the core. Therefore, rebound characteristics are degraded to reduce flight distance.

The filler, which can be typically used for the core of solid golf ball, includes for example, inorganic filler (such as zinc oxide, barium sulfate, calcium carbonate and the like), high specific gravity metal powder filler (such as tungsten powder, molybdenum powder and the like), and the mixture thereof. An amount of the filler is not limited and can vary depending on the specific gravity and size of the cover and core, but is from 3 to 50 parts by weight, preferably from 10 to 30 parts by weight, based on 100 parts by weight of the polybutadiene. When the amount of the filler is smaller than 3 parts by weight, it is difficult to adjust the weight of the resulting golf ball. On the other hand, when the amount of the filler is larger than 50 parts by weight, the weight ratio of the rubber component in the core is small, and thus rebound characteristics reduce too much.

The rubber composition for the core of the golf ball of the present invention can contain other components, which have been conventionally used for preparing the core of solid golf balls, such as antioxidant or peptizing agent. If used, an amount of the antioxidant is preferably 0.1 to 1.0 parts by weight, and an amount of the peptizing agent is preferably 0.1 to 5.0 parts by weight, based on 100 parts by weight of the polybutadiene.

Figure 2:
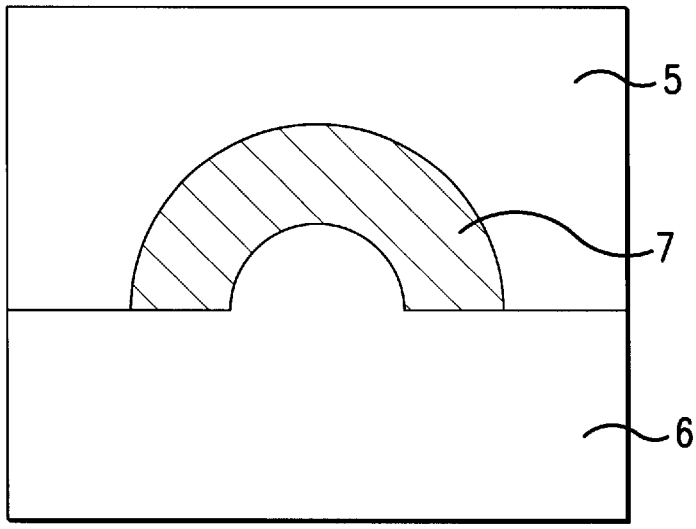
FIG. 2 is a schematic cross section illustrating one embodiment of a mold for molding an outer core of the golf ball of the present invention.
Figure 3:
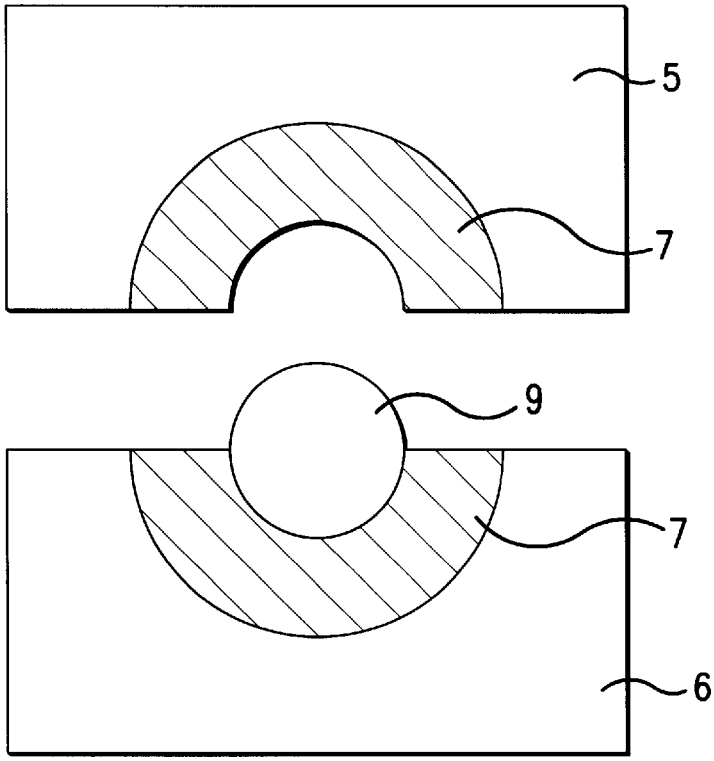
FIG. 3 is a schematic cross section illustrating one embodiment of a mold for molding a core of the golf ball of the present invention.

The process of producing the core of the golf ball of the present invention will be explained with reference to FIG. 2 and FIG. 3. FIG. 2 is a schematic cross section illustrating one embodiment of a mold for molding an outer core of the golf ball of the present invention. FIG. 3 is a schematic cross section illustrating one embodiment of a mold for molding a core of the golf ball of the present invention. The rubber composition for the inner core is molded by using an extruder to form a cylindrical unvulcanized inner core. The rubber composition for the outer core is then vulcanized by press-molding, for example, at 120 to 160° C. for 2 to 30 minutes using a mold having a semi-spherical cavity 5 and a male plug mold 6 having a semi-spherical convex having the same shape as the inner core as described in FIG. 2 to obtain a vulcanized semi-spherical half-shell 7 for the outer core. An unvulcanized inner core 9 is covered with the two vulcanized semi-spherical half-shells 7 for the outer core, and then vulcanized by integrally press-molding, for example, at 140 to 170° C. for 10 to 40 minutes in a mold 8 for molding a core, which is composed of an upper mold and a lower mold, as described in FIG. 3 to obtain core 4. The core 4 is composed of the inner core 1 and the outer core 2 formed on the inner core.

In the golf ball of the present invention, the inner core 1 has a diameter of 34.0 to 37.4 mm, preferably 35.2 to 37.2 mm. When the diameter of the center is smaller than 34.0 mm, it is required to lower a hardness in order to improve shot feel. Therefore, the rebound characteristics of the inner core are degraded. On the other hand, when the diameter of the center is larger than 37.4 mm, it is required to reduce the thickness of the outer core or the cover to a thickness less than a desired thickness. Therefore, the rebound characteristics of the inner core are degraded.

In the golf ball of the present invention, the inner core has a JIS-C center hardness of 65 to 75. When the hardness is smaller than 65, the inner core is too soft, and rebound characteristics are degraded. On the other hand, the hardness is larger than 75, the inner core is too hard, and shot feel is poor. The center hardness of the inner core is determined by measuring a hardness at the center point of a core, after the core, which is formed by integrally press-molding the inner core and the outer core, is cut into two equal parts.

In the golf ball of the present invention, the outer core has a thickness of 0.8 to 2.0 mm, preferably 1.0 to 1.5 mm. When the thickness is smaller than 0.8 mm, rebound characteristics can not be sufficiently obtained, even if the hardness of the outer core is heightened, and durability is degraded. On the other hand, when the thickness is larger than 2.0 mm, the hardness of the core is too high because of the large thickness, even if the hardness of the outer core is lowered, and thus shot feel is poor. In the golf ball of the present invention, the outer core has a JIS-C surface hardness of 75 to 85. When the hardness is smaller than 75, the outer core is too soft, and thus rebound characteristics are degraded. On the other hand, the hardness is larger than 85, the outer core is too hard, and thus shot feel is poor.

A difference between a surface hardness of the outer core and a center hardness of the inner core is not more than 15, preferably 0 to 13. When the difference is larger than 15, the hardness difference is too large, and thus durability is degraded. As used herein, the term "a JIS-C surface hardness of the outer core" means the surface hardness of the core having a two-layered structure, which is formed by integrally press-molding the inner core and the outer core.

In the golf ball of the present invention, the vulcanized semi-spherical half-shell for the outer core before covering the inner core has a JIS-C hardness of 5 to 70, preferably 10 to 40. When the hardness is smaller than 5, the half-shell for the outer core is too soft to take a perfect semi-spherical shape. Therefore, it is difficult to cover the inner core with it. On the other hand, the hardness is larger than 70, the core having a two-layered structure, which is formed by covering the inner core and integrally press-molding it, can not obtain desired physical properties.

One or more layers of cover 3 is then covered on the core 4. In the golf ball of the present invention, the cover 3 has a Shore D hardness of 45 to 70, preferably 48 to 60. When the hardness is smaller than 45, the cover is too soft, and thus rebound characteristics are degraded. On the other hand, when the hardness is larger than 70, the cover is too hard, and thus shot feel is poor. The cover 3 preferably has a thickness of 0.8 to 3.0 mm. When the thickness is smaller than 0.8 mm, durability is degraded. On the other hand, when the thickness is larger than 3.0 mm, shot feel is poor.

The cover contains ionomer resin as a base resin. The ionomer resin used for the cover of the present invention may be one, which has been conventionally used for the cover of golf balls. Examples of the ionomer resin will be shown by a trade name thereof. Examples of the ionomer resin, which is commercially available from Mitsui Du Pont Polychemical Co., Ltd. include Hi-milan 1605 (Na), Hi-milan 1707 (Na), Hi-milan AM7318 (Na), Hi-milan 1706 (Zn), Hi-milan AM7315 (Zn), Hi-milan AM7317 (Zn), Hi-milan AM7311 (Mg) and Hi-milan MK7320 (K); and Hi-milan 1856 (Na), Hi-milan 1855 (Zn), Hi-milan AM7316 (Zn) and the like as the terpolymer ionomer resin. Examples of the ionomer resin, which is commercially available from Du Pont U.S.A., include Surlyn 8920 (Na), Surlyn 8940 (Na), Surlyn AD8512 (Na), Surlyn 9910 (Zn), Surlyn AD8511 (Zn), Surlyn 7930 (Li) and Surlyn 7940 (Li); and Surlyn AD8265 (Na), Surlyn AD8269 (Na) and the like as the terpolymer ionomer resin. Examples of the ionomer resin, which is commercially available from Exxon Chemical Co., include Iotek 7010 (Zn), Iotek 8000 (Na) and the like. Incidentally, Na, Zn, K, Li and Mg, which are described in parentheses after the trade name of the above ionomer resin, indicate their neutralizing metal ion species. These ionomer resins are used alone or in combination thereof.

The cover for the golf ball of the present invention can contain a soft thermoplastic resin other than the ionomer resin. The soft thermoplastic resin is preferably a functional group modified styrene-butadiene-styrene block copolymer or a functional group modified styrene-isoprene-styrene block copolymer. Examples thereof include hydrogenated styrene-isoprene-styrene block copolymers having terminal OH groups, which are commercially available from Kuraray Co., Ltd. under the trade name of "HG-252"; styrene-butadiene-styrene (SBS) structured block copolymers having polybutadiene block with epoxy groups, which are commercially available from Daicel Chemical Industries, Ltd. under the trade name of "Epofriend AT014", "Epofriend AT015", "Epofriend AT000" and the like; and SBS structured copolymers having polybutadiene block with epoxy group, which are then hydrogenated, commercially available from Daicel Chemical Industries, Ltd. under the trade name of "Epofriend AT018", "Epofriend AT019" and the like. In this context, the term "SBS structure" means polystyrene-polybutadiene-polystyrene structure in which polybutadiene block is sandwiched by two polystyrene blocks.

The cover used in the present invention may optionally contain pigments (such as titanium dioxide, etc.), fillers (such as barium sulfate, etc.) and the other additives such as a dispersant, an antioxidant, a UV absorber, a photostabilizer and a fluorescent agent or a fluorescent brightener, etc., in addition to the resin component, as long as the addition of the additives does not deteriorate the desired performance of the golf ball cover.

A method of covering on the core with the cover 3 is not specifically limited, but may be a conventional method. For example, there can be used a method comprising molding the cover composition into a semi-spherical half-shell in advance, covering the core, which is covered with the outer core, with the two half-shells, followed by pressure molding at 130 to 170° C. for 1 to 5 minutes, or a method comprising injection molding the cover composition directly on the core, which is covered with the outer core, to cover it. At the time of cover molding, many depressions called "dimples" may be optionally formed on the surface of the golf ball. Furthermore, paint finishing or marking stamp may be optionally provided after cover molding for serving commercial sell.

EXAMPLES

The following Examples and Comparative Examples further illustrate the present invention in detail but are not to be construed to limit the scope of the present invention.

(i) Production of Unvulcanized Spherical Inner Core

The rubber compositions for the inner core shown in Table 1 were mixed, and then extruded to obtain cylindrical unvulcanized plugs.

(ii) Production of Vulcanized Semi-spherical Half-shell for the Outer Core

The rubber compositions for the outer core shown in Table 1 were mixed, and then vulcanized by press-molding at 120 to 160° C. for 2 to 10 minutes in the mold (5, 6) as described in FIG. 3 to obtain vulcanized semi-spherical half-shells 7 for the outer core.

(iii) Production of Core

The cylindrical unvulcanized plugs 9 produced in the step (i) were covered with the two vulcanized semi-spherical half-shells 7 for the outer core produced in the step (ii), and then vulcanized by press-molding at 140 to 170° C. for 10 to 40 minutes in the mold 8 as described in FIG. 4 to obtain cores 4 having a two-layered structure. A surface hardness of the resulting core was measured. The results are shown in Table 1 as a surface hardness of outer core. Hardness of the inner core at center point and 15 mm from the center point were also measured, and the results are shown in Table 1.

TABLE 1

| Core composition | (parts by weight) A | B | C | D | E | F |
|---|---|---|---|---|---|---|
| (Inner core composition) | | | | | | |
| Polybutadiene *1 | 100 | 100 | 100 | 100 | 100 | 100 |
| Zinc acrylate | 28 | 27 | 23 | 31 | 25 | 28 |
| Dicumyl peroxide | 1.0 | 1.2 | 2.5 | 0.9 | 2.5 | 1.0 |
| Zinc oxide | 20 | 20 | 22 | 18 | 20.5 | 20 |
| Antioxidant *2 | 0.5 | 0.5 | 0.5 | 0.5 | 0.5 | 0.5 |
| Peptizing agent *3 | 0.3 | 0.3 | — | — | 0.3 | 0.3 |
| (Outer core composition) | | | | | | |
| Polybutadiene *1 | 100 | 100 | 100 | 100 | 100 | 100 |
| Zinc acrylate | 33 | 30 | 33 | 35 | 33 | 20 |
| Dicumyl peroxide | 1.8 | 1.8 | 1.8 | 1.8 | 1.8 | 2.0 |
| Zinc oxide | 18 | 19.5 | 18 | 17 | 18 | 23 |
| Antioxidant *2 | 0.5 | 0.5 | 0.5 | 0.5 | 0.5 | 0.5 |
| Peptizing agent *3 | 0.3 | 0.3 | 0.3 | 0.3 | 0.3 | 0.3 |
| JIS-C hardness of inner core | | | | | | |
| Center point(a) | 75 | 70 | 65 | 80 | 60 | 75 |
| 15 mm from center point | 80 | 85 | 85 | 80 | 75 | 80 |
| JIS-C hardness of outer core | | | | | | |
| Surface hardness(b) | 85 | 80 | 85 | 88 | 85 | 72 |
| Difference in hardness (b-a) | 10 | 10 | 20 | 8 | 25 | 3 |

*1 Polybutadiene (trade name "BR-11") available from JSR Co., Ltd.
*2 Antioxidant (trade name "Yoshinox 425") from Yoshitomi Pharmaceutical Ind., Ltd.
*3 Diphenyl disulfide available from Sumitomo Seika Co., Ltd.

(iv) Preparation of Cover Compositions

The formulation materials shown in Table 2 were mixed using a kneading type twin-screw extruder to obtain pelletized cover compositions. The extrusion condition was, a screw diameter of 45 mm, a screw speed of 200 rpm, and a screw L/D of 35.

The formulation materials were heated at 200 to 260° C. at the die position of the extruder. The Shore D hardness of the resulting cover compositions was also shown in Table 2. The test methods are described later.

TABLE 2

| Cover composition | (parts by weight) I | II | III |
|---|---|---|---|
| Hi-milan 1605 *4 | 5 | — | — |
| Hi-milan 1555 *5 | 10 | — | — |
| Hi-milan 1855 *6 | 85 | — | — |
| Surlyn AD8512 *7 | — | 25 | 30 |
| Surlyn AD8511 *8 | — | 25 | 30 |
| Epofriend A1010 *9 | — | 15 | 40 |
| Septon HG-252 *10 | — | 35 | — |
| Titanium dioxide | 2.0 | 2.0 | 2.0 |

TABLE 2-continued

| Cover composition | (parts by weight) I | II | III |
|---|---|---|---|
| Barium sulfate | 2.0 | 2.0 | 2.0 |
| Shore D hardness | 59 | 51 | 40 |

*4: Hi-milan 1605 (trade name), ethylene-methacrylic acid copolymer ionomer resin obtained by neutralizing with sodium ion, manufactured by Mitsui Du Pont Polychemical Co., Ltd., flexural modulus: 3,010 kgf/cm$^2$, Shore D hardness: 61
*5: Hi-milan 1555 (trade name), ethylene-methacrylic acid copolymer ionomer resin obtained by neutralizing with sodium ion, manufactured by Mitsui Du Pont Polychemical Co., Ltd., flexural modulus: 2,500 kgf/cm$^2$, Shore D hardness: 62
*6: Hi-milan 1855 (trade name), ethylene-methacrylic acid-isobutyl acrylate terpolymer ionomer resin obtained by neutralizing with zinc ion, manufactured by Mitsui Du Pont Polychemical Co., Ltd., flexural modulus: 900 kgf/cm$^2$, Shore D hardness: 56
*7: Surlyn AD8512 (trade name), ethylene-methacrylic acid copolymer ionomer resin obtained by neutralizing with zinc ion, manufactured by DuPont USA Co., flexural modulus = 2,240 kgf/cm$^2$, Shore D hardness = 60
*8: Surlyn AD8511 (trade name), ethylene-methacrylic acid copolymer ionomer resin obtained by neutralizing with sodium ion, manufactured by DuPont USA Co., flexural modulus = 2,850 kgf/cm$^2$, Shore D hardness = 62
*9: Epofriend AT1010 (trade name), styrene-butadiene-styrene block copolymer with epoxy groups, manufactured by Daicel Chemical Industries, Ltd., JIS-A hardness = 67, styrene/butadiene (weight ratio) = 40/60, content of epoxy = about 1.5 to 1.7% by weight
*10: Septon HG-252 (trade name), hydrogenated styrene-isoprene-styrene block copolymer having a terminal OH group, manufactured by Kuraray Co. Ltd., JIS-A hardness = 80, content of styrene = 40% by weight Examples 1 to 3 and Comparative Examples 1 to 9

The cover composition was covered on the resulting core 4 having two-layered structure by injection molding to form a cover layer 3. Then, paint was applied on the surface to produce golf ball having a diameter of 42.7 mm. With respect to the resulting golf balls, weight, compression, flight distance, durability and shot feel were measured or evaluated. The results are shown in Tables 3 and 4. The test methods are described later.

Comparative Example 10

A golf ball having a diameter of 42.7 mm was obtained in the same manner as described in Examples 1 to 3 and Comparative Examples 1 to 9, except that the rubber composition for the inner core shown in Table 1 was mixed, and then vulcanized by press-molding at 160° C. for 30 minutes in the mold composed of an upper mold and a lower mold having a semi-spherical cavity. With respect to the resulting golf ball, weight, compression, flight distance, durability and shot feel were measured or evaluated in the same manner as described in Examples 1 to 3 and Comparative Examples 1 to 9. The results are shown in Table 4.

(Test Method)

(1) Shore D Hardness of Cover

The Shore D hardness was determined according to ASTM D-2240, using a sample of a stack of the three or more sheets which were obtained by heat and press molding the each cover composition into a sheet having a thickness of about 2 mm and storing at 23° C. for 2 weeks.

(2) Ball Compression

The ball compression was determined by measured the deformation amount when applying from an initial load of 10 kg to a final load of 130 kg on the golf ball.

(3) Flight Distance

A No.1 wood club (a driver) was mounted to a swing robot manufactured by True Temper Co. and the resulting golf ball was hit at a head speed of 45 m/second, flight distance to the dropping point (carry) was measured.

(4) Durability

A No.1 wood club (a driver) was mounted to a swing robot manufactured by True Temper Co. and the resulting golf ball was hit at a head speed of 45 m/second, repeatedly. The durability is the number of hit until the cover of the golf ball cracks, and is indicated by an index when that of Example 10 is 100.

(5) Shot Feel

The shot feel of the resulting golf ball was evaluated by 10 top professional golfers according to practical hitting test by a driver. The evaluation criteria are as follows.

(Evaluation criteria)

◎: Good

○: Fairly good

X: Poor

TABLE 3

| | Example No. | | | Comparative Example No. | | |
|---|---|---|---|---|---|---|
| Test item | 1 | 2 | 3 | 1 | 2 | 3 |
| Core composition | A | A | B | A | C | D |
| Cover composition | I | II | II | III | I | II |
| Diameter of inner core (mm) | 36.1 | 36.1 | 37.1 | 36.1 | 36.1 | 36.1 |
| Thickness of outer core (mm) | 1.4 | 1.4 | 1.0 | 1.4 | 1.4 | 1.4 |
| Thickness of cover (mm) | 1.9 | 1.9 | 1.8 | 1.9 | 1.9 | 1.9 |
| Weight of ball (g) | 45.4 | 45.4 | 45.4 | 45.4 | 45.4 | 45.4 |
| Ball compression | 2.75 | 2.85 | 2.80 | 3.05 | 3.00 | 2.95 |
| Flight distance (yard) | 231 | 230 | 230 | 224 | 221 | 229 |
| Durability | 130 | 125 | 130 | 120 | 105 | 110 |
| Shot feel | ◎ | ◎ | ◎ | ○ | ◎ | x |

TABLE 4

| | Comparative Example No. | | | | | | |
|---|---|---|---|---|---|---|---|
| Test item | 4 | 5 | 6 | 7 | 8 | 9 | 10 |
| Core composition | E | F | A | A | A | A | A |
| Cover composition | II | II | I | I | I | II | I |
| Diameter of inner core (mm) | 37.1 | 36.1 | 32.9 | 39.5 | 37.1 | 34.5 | 36.1 |
| Thickness of outer core (mm) | 1.0 | 1.4 | 1.8 | 0.9 | 0.5 | 2.8 | 1.4 |
| Thickness of cover (mm) | 1.8 | 1.9 | 3.1 | 0.7 | 2.3 | 1.3 | 1.9 |
| Weight of ball (g) | 45.4 | 45.4 | 45.2 | 45.6 | 45.4 | 45.5 | 45.4 |
| Ball compression | 3.10 | 3.05 | 2.80 | 2.95 | 2.80 | 2.90 | 2.85 |
| Flight distance (yard) | 221 | 221 | 221 | 221 | 220 | 229 | 224 |
| Durability | 105 | 110 | 125 | 115 | 105 | 125 | 100 |
| Shot feel | ○ | ○ | ◎ | ◎ | ◎ | x | ◎ |

As is apparent from the comparison of the physical properties of the golf balls of Examples 1 to 3 shown in Table 3 with those of the golf balls of Comparative Examples 1 to 10 shown in Tables 3 and 4, the golf ball of the present invention of Examples 1 to 3 adjusted a diameter of the inner core, a thickness and a surface hardness of the outer core and a hardness of the cover to a specified range, and produced by using the method of the present invention, which the unvulcanized inner core is covered with the two vulcanized semi-spherical half-shells for the outer core, and then vulcanized by integral molding to obtain a two-layered core, have better durability than the golf ball of Comparative Example 10 produced without using the method of the present invention. The golf balls of the present invention have longer flight distance than the golf ball of Comparative Examples 1, 2 and 4 to 8, and have better shot feel at the time of hitting than the golf ball of Comparative Examples 3 and 9.

On the other hand, the golf ball of Comparative Example 1 has lower cover hardness, and thus rebound characteristics are degraded to reduce flight distance. The golf ball of Comparative Example 2 has larger difference between a center hardness of the inner core and a surface hardness of the outer core, and thus has poor shot feel. The golf ball of Comparative Example 3 has larger center hardness of the inner core and larger surface hardness of the outer core, and thus has poor shot feel. The golf ball of Comparative Example 4 has larger difference between a center hardness of the inner core and a surface hardness of the outer core, and thus has poor durability. Also, it has lower center hardness of the inner core, and thus rebound characteristics are degraded to reduce flight distance. The golf ball of Comparative Example 5 it has lower surface hardness of the outer core, and thus rebound characteristics are degraded to reduce flight distance.

The golf ball of Comparative Example 6 has smaller diameter of the inner core and larger thickness of the outer core, and thus has poor shot feel. Since it is required to lower the hardness of the inner core in order to improve the shot feel, rebound characteristics thereof are degraded to reduce flight distance. The golf ball of Comparative Example 7 has larger diameter of the inner core and smaller thickness of the outer core, and thus has lower hardness. Therefore, rebound characteristics thereof are degraded to reduce flight distance. The golf ball of Comparative Example 8 has smaller thickness of the outer core, and thus rebound characteristics can not be sufficiently obtained, even if the hardness is heightened, and has poor durability. The golf ball of Comparative Example 9 has smaller diameter of the inner core and larger thickness of the outer core, and thus has higher hardness of the core, even if the hardness of the outer core is lowered. Therefore, shot feel thereof is poor.

The golf ball of Comparative Example 10 is produced, without using the method of the present invention, by using a method of covering a vulcanized spherical inner core with a outer core, and then vulcanizing to obtain the core, and thus the inner core is vulcanized twice to deteriorate the inner core by heat. Therefore, rebound characteristics and durability thereof are degraded.

What is claimed is:

1. A multi-piece solid golf ball comprising a core consisting of an inner core and an outer core formed on the inner core and a cover layer covering the core, wherein the inner core has a diameter of 35.2 to 37.2 mm and a JIS-C center hardness of 65 to 75, and is formed from press molded rubber composition comprising a polybutadiene, a zinc acrylate co-crosslinking agent, an organic peroxide, and, based on 100 parts by weight of the polybutadiene, 10 to 30 parts by weight of a zinc oxide filler, the outer core has a thickness of 0.8 to 2.0 mm and a JIS-C surface hardness of 75 to 85, and is formed from press molded rubber composition comprising a polybutadiene, a co-crosslinking agent, an organic peroxide, and a filler, and the cover has a thickness of 0.8 to 3.0 mm and a Shore D hardness of 45 to 70, and contains ionomer resin as a base resin, wherein a difference between the JIS-C center hardness of the inner core and the JIS-C surface hardness of the outer core is selected be within the range 0 to 13.

2. The multi-piece solid golf ball of claim 1, wherein the zinc acrylate content of the inner core is from 23 to 31 parts by weight based on 100 parts by weight of the polybutadiene.

3. The multi-piece solid golf ball of claim 2, wherein zinc oxide content of the inner core is from 18 to 22 parts by weight based on 100 parts by weight of the polybutadiene.

4. The multi-piece solid golf ball of claim 1, wherein the diameter of the inner core is 36.1 mm, the thickness of the outer core is 1.4 mm, and the thickness of the cover is 1.9 mm.

5. The multi-piece solid golf ball of claim 1, wherein the diameter of the inner core is 37.1 mm, the thickness of the outer core is 1.4 mm, and the thickness of the cover is 1.9 mm.

* * * * *